US006942104B2

(12) United States Patent
Gallagher et al.

(10) Patent No.: US 6,942,104 B2
(45) Date of Patent: Sep. 13, 2005

(54) ROTOR WITH MULTIPLE FOILS FOR SCREENING APPARATUS FOR PAPERMAKING PULP

(75) Inventors: Brian J. Gallagher, Litchfield, NH (US); Richard G. Meese, Wilmington, DE (US)

(73) Assignee: GL&V Management Hungary Kft., Budapest (HU)

( * ) Notice: Subject to any disclaimer, the term of this patent is extended or adjusted under 35 U.S.C. 154(b) by 22 days.

(21) Appl. No.: 10/653,711

(22) Filed: Sep. 2, 2003

(65) Prior Publication Data

US 2005/0045530 A1 Mar. 3, 2005

(51) Int. Cl.[7] ..... B07B 1/20
(52) U.S. Cl. ..... 209/273; 209/283; 209/306
(58) Field of Search ..... 209/273, 283, 209/299, 305, 306; 219/415, 499

(56) References Cited

U.S. PATENT DOCUMENTS

| | | | | | |
|---|---|---|---|---|---|
| 3,255,883 | A | | 6/1966 | Nelson | |
| 3,953,325 | A | * | 4/1976 | Nelson | 209/273 |
| 4,067,800 | A | | 1/1978 | Young | |
| 4,097,374 | A | | 6/1978 | Young | |
| 4,193,865 | A | * | 3/1980 | Aario | 209/240 |
| 4,234,417 | A | | 11/1980 | Gauld et al. | |
| 4,383,918 | A | | 5/1983 | Chupka et al. | |
| 4,396,502 | A | * | 8/1983 | Justus | 209/273 |
| 4,676,903 | A | * | 6/1987 | Lampenius et al. | 210/413 |
| 4,744,894 | A | | 5/1988 | Gauld | |
| 4,836,915 | A | * | 6/1989 | Frejborg | 209/273 |
| 4,894,147 | A | * | 1/1990 | Rajala | 209/273 |
| 4,919,797 | A | | 4/1990 | Chupka et al. | |
| 5,176,261 | A | * | 1/1993 | Holz | 209/273 |
| 5,383,616 | A | | 1/1995 | Svaighert | |
| 5,547,083 | A | | 8/1996 | Alajaaski et al. | |
| 5,601,690 | A | | 2/1997 | Gauld et al. | |
| 5,645,724 | A | | 7/1997 | Lamort | |
| 6,010,012 | A | | 1/2000 | Gero | |
| 6,138,836 | A | | 10/2000 | Valli | |
| 6,193,073 | B1 | | 2/2001 | Chupka et al. | |
| 6,241,102 | B1 | | 6/2001 | Lindberg et al. | |
| 6,571,957 | B1 | * | 6/2003 | Doelle et al. | 209/273 |
| 6,588,599 | B2 | | 7/2003 | Gscheider et al. | |
| 2001/0011641 | A1 | * | 8/2001 | Fukudome et al. | 209/306 |
| 2004/0108254 | A1 | * | 6/2004 | Olson et al. | 209/306 |

* cited by examiner

*Primary Examiner*—Donald P. Walsh
*Assistant Examiner*—Joseph C. Rodriguez
(74) *Attorney, Agent, or Firm*—James Earl Lowe, Jr.

(57) ABSTRACT

A rotor adapted for use in a hydrodynamic device comprising a cylindrical screen having a circumferentially continuous apertured zone. The rotor has an axis of rotation and includes a substantially cylindrical outer surface adjacent the cylindrical screen surface. The rotor further includes a plurality of sets of a plurality of adjacent vane members supported above a substantially cylindrical outer surface of a rotor by a plurality of brackets. The rotor has an axis of rotation and is mounted within and co-axial with the cylindrical screen to define an annular screening chamber between the rotor and the screen. The sets are equally spaced apart in a direction circumferential to the rotor axis, and the vane members extend the length of the screening chamber parallel to the rotor axis.

41 Claims, 2 Drawing Sheets

ROTOR WITH MULTIPLE FOILS FOR SCREENING APPARATUS FOR PAPERMAKING PULP

BACKGROUND OF THE INVENTION

This invention relates generally to machinery for screening paper-making pulp and, more particularly, to a screening apparatus having an enhanced rotor for promoting screening efficiency together with power conservation.

The Pulp and Paper Industry uses pressure screens to separate undesirable materials from usable fiber in the Industries' various processes. The typical pressure screen has a cylindrical screen plate with apertures in it. Inside of that is a central rotating element, the rotor, to provide pressure pulses that function to "clean" the surface of the screen plate and provide a motive force to move fibers through the plate. The screen rotors are characterized by the speed of rotation at the outermost point of the rotor (tip speed, usually expressed as meters/sec) and the frequency with which a rotor element passes a point on the screen (Hertz). The design of the rotor element controls the pulse generation function of the rotor.

Different types of pulp from different manufacturing processes require variations of the screening technique. For the purpose of this invention, the class of fibers produced by mechanical means will be considered. Examples of some of the processes which produce this type of fiber are stone groundwood, mechanical refiner groundwood, thermo-mechanical and chemi-thermo-mechanical pulps. In each of these processes the primary role of the screen is to separate the refined fibers from larger fiber bundles, called "shives" in the industry. The separated shives are recycled for additional refining. Some of the processes also desire separation of some of the longer fibers from the shorter fibers by the same mechanism of screening.

When screening mechanical pulps, the short flexible fibers that need to pass through the screen easily make the turn into the screen apertures. The longer less flexible fibers that require more refining action before they are ready to pass through the screen, need to be lifted away from the screen apertures and removed for further processing.

An example of current technology could be called a cage type rotor. A cage type rotor uses axial bars running close to the surface of the screen, and may have either notches in the trailing edge or small vanes on the surface of the element where its clearance with the screen is becoming greater. The notches or small vanes are angled toward the bottom, or the reject end of the screen. The element is typically called a "foil" and has a blunt leading edge and is triangular or square in cross section. These foil elements are suspended from a relatively narrow central core of the rotor, leaving the majority of the space inside the screen as void space, or space that is taken up by the fiber suspension. These rotors may also have a vertical plate either attached to the rotor arms, or extending from the central core and between the rotor arms extending to the foil elements.

Each foil member extends axially for the full length of the screen. The cage type rotor generates pulses, which sweep around the circumference over the full length of the screen with every revolution of the rotor. Such rotors consume excess power due to stirring action on the pulp residing inboard of the foil members. This power is wasted because it does not contribute sufficiently to the screening action.

To reduce the magnitude of the effects described above, many machines are made with closed rotors, that is, rotors having a full cylindrical surface on which bumps and depressions are directly attached without support arms to generate localized pressure pulsations. Depending upon their specific geometries, these may offer lower specific power consumption than cage rotors; and, because the bumps and depressions are distributed over the rotor surface, the pressure pulsations are distributed about the screen surface and do not concentrate alternating stresses along the aperture pattern One improvement to the cage and closed type rotors provides a large diameter hub on which the hydrodynamic foils are each mounted on short support arms to reduce the volume of the screening chamber and to reduce specific power consumption. This configuration can also be used to control flow patterns within the screening zone of the screen body.

SUMMARY OF THE INVENTION

One of the objects of the invention is to provide a hydrodynamic device that more effectively lifts the fibers needing further processing away from the screen surface and controls the flow pattern generated within the area between the rotor hub and the screen cylinder, thus improving the ability of the screening apparatus to remove shives and long fibers.

This invention provides a rotor adapted for use in a hydrodynamic device comprising a cylindrical screen having a circumferentially continuous apertured zone. The rotor has an axis of rotation and includes a substantially cylindrical outer surface adjacent the cylindrical screen. The rotor further includes a plurality of sets of a plurality of adjacent vane members supported above a substantially cylindrical outer surface of a rotor by a plurality of brackets. The rotor has an axis of rotation and is mounted within and co-axial with the cylindrical screen to define an annular screening chamber between the rotor and the screen. The sets are equally spaced apart in a direction circumferential to the rotor axis, and the vane members extend the length of the screening chamber parallel to the rotor axis.

In one embodiment, two of the vane members are air foils, and the first air foil is spaced apart from the screen surface, and the second air foil is spaced apart from the screen surface but closer to the screen surface than the first air foil. There is also a third vane member, and the third vane member is spaced apart from the screen surface but closer to the screen surface than the second air foil. The third vane member is generally an obtuse triangle in shape, with a blunt leading edge in the direction of movement of the vane member into the pulp, with one side generally parallel to the screen surface, another side is rearward of pulp flow and is slightly angled relative to the screen surface, and the last side is forward of pulp flow and is angled relative to the screen surface.

The foregoing and other aspects will become apparent from the following detailed description of the invention when considered in conjunction with the accompanying drawing figures.

BRIEF DESCRIPTION OF THE DRAWINGS

FIG. 1 also shows an additional mechanical attachment on top of the rotor cylinder and foil arm, which is designed to exclude large solid particles from entering the screening zone.

Figure 1:
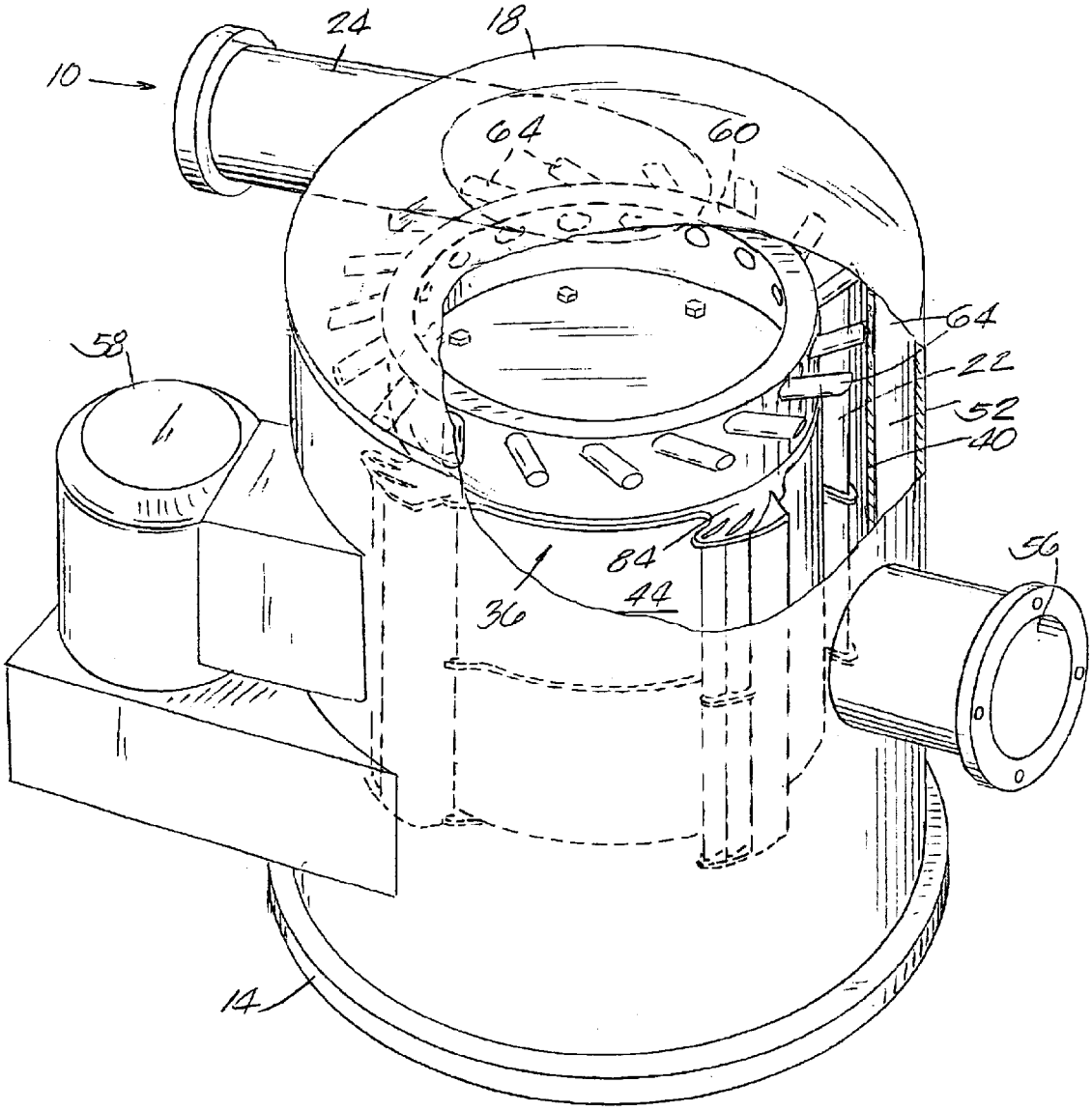
FIG. 1 is a perspective view, partially in section, illustrating a generalized embodiment of a pulp fine-screening device and the overall structure of such machine that includes an improved rotor of this invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF A PREFERRED EMBODIMENT OF THE INVENTION

Figure 2:
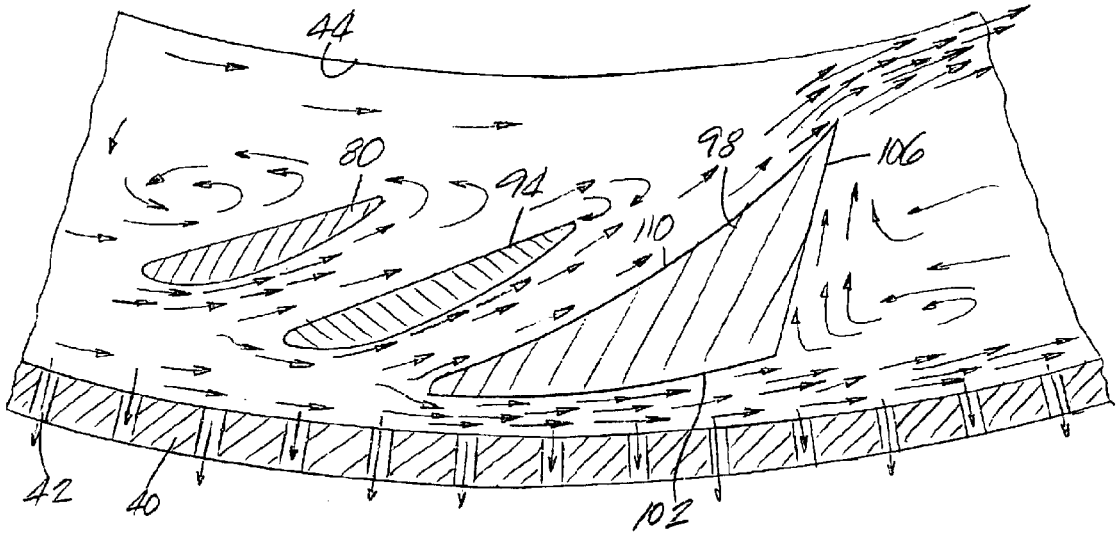
FIG. 2 is a cross-sectional top view of the rotor of FIG. 1, illustrating the relationship between the rotor surface, the multiple air foils, and the screen surface. The arrows depict the flow of the pulp past the rotor, as the rotor moves left in this Figure relative to the screen surface.

Referring to FIG. 1, common features of a hydrodynamic device such as pulp screening equipment can be seen. A screening apparatus 10 is made up of a base 14 upon which a housing 18 is mounted. (The apparatus shown here is vertically oriented, but it is known that a screening apparatus may be in any orientation between horizontal and vertical.) Housing 18 has an end mounted inlet chamber 22 with a pulp inlet 24 through which pulp is tangentially fed for screening. The apparatus includes a rotor 36 and a screen 40 having apertures 42 (as shown in FIG. 2) through which accepted fiber along with pulp liquor has a normal outflow. The pulp flows into an annular space or screening chamber between the rotor 36 and the perforated portion of a screen 40.

Rotor 36 has a closed top and a generally cylindrical surface 44. More particularly, the rotor has an axis of rotation and includes a substantially cylindrical outer surface 44 adjacent the cylindrical screen 40, and the screen 40 is a cylindrical screen having a circumferentially continuous apertured zone in the screen surface. The space outboard of the screen 40 contains inlet chamber 52 which is drained by accepts discharge 56. The rotor 36 is rotated by a prime mover 58 in a conventional manner.

In this embodiment, the rotor 36 further includes a collar 60 attached to the pulp feed end of the rotor 36, and the rotor 36 further includes a plurality of spaced apart solid rods 64 extending radially from the collar 60, with each rod 64 being angled from the radial direction in a direction away from the direction of rotor rotation. The spacing of the rods 64 is designed to inhibit the movement of large solid particles into the screening chamber and to protect the foils from possible damage.

As shown in FIGS. 1 and 2, the rotor 35 further includes two or more "foil" type shapes or vane members per set 80 of vane members, the vane members being suspended from a large diameter central hub or rotor surface 44. The rotor surface 44 limits the void space within the screen 40. The clearance between the rotor surface 44 and the screen surface is important, and should be between 35 and 75 millimeters, and preferably 50 millimeters.

More particularly, the sets 80 of vane members are supported above the substantially cylindrical outer surface of the rotor 36 by a plurality of brackets 84, as shown in FIG. 1, with one bracket at each end and one or more brackets in the middle of each set 80 of vane members. The sets 80 of vane members are equally spaced apart in a direction circumferential to the rotor axis, and the vane members extend the length of the screening chamber parallel to the rotor axis. There are preferably four sets on a rotor sized for a 20 inch diameter screen cylinder, or one set per every five inches of diameter for larger or smaller rotors.

The working sets 80 of vane members of the rotor 36 each include two or more separate lifting surfaces working in cooperation with each other. In the preferred embodiment, there are three. The first two vane members 90 and 94 are shaped like air foils, with a shape that imitates the cross section of a typical light aircraft wing. The first foil 90 is positioned farthest away from the screen surface at an angle of attack relative to that surface. It is also the shortest foil in chord dimension (the length from the nose to the tail of the foil in the flow direction). The second foil 94 trails the first foil 90 in the direction of rotation, is nearer the screen surface, and is also positioned at an angle of attack similar to the first foil 90. More specifically, the foil sections are asymmetrical, with a highly cambered shape, but not so high to cause significant flow separation. The negative pressure behind the foil shape pulls the pulp over the foil.

The third element or vane member 98 trails the second foil 94 in the direction of rotation, and is uniquely shaped to (1) provide a pronounced negative pulse at the screen surface; (2) direct flow emanating over the top surfaces of the two leading foils centripetally to mix with the pulp suspension at the surface of the center hub of the rotor 36; and (3) provide fluid flow patterns that induce mixing zones preceding the lead foil 90 and trailing the uniquely shaped third vane member 98. More particularly, the third vane member 98 is spaced apart from the screen surface but closer to the screen surface than the second air foil 94. The third vane member 98 is generally an obtuse triangle in shape, with a blunt leading edge in the direction of movement of the vane member into the pulp, as shown in FIG. 2, with one side 102 generally parallel to the screen surface, another side 106 rearward of pulp flow is and is slightly angled relative, and the last side 110 is forward of pulp flow and is angled relative to the screen surface.

The existence of the air foils 90 and 94 is a departure from previous practice and controls fluid streamlines and flow patterns within the available void space to promote mixing. The range through which the invention operates is from 10–30 meters/second tip speed and with a vane group frequency range of 12.5–75 Hz. The invention rotor described is intended to run at between 10 and 28 meters/sec tip speed, and more preferably, 15 meters/sec tip speed and with a number of groups of elements to produce approximately 40 Hz. The clearance between the rotor tips and the screen surface is between 1 and 10 millimeters, and more preferably, 2 millimeters. The screening apparatus of this invention is usable with pulp consistencies of between 0.5 and 2.5%, and more preferably 1 to 1.8%, and most preferably, 1%.

In other embodiments (not shown), additional vane members or foils or other unique shapes can be used especially for different pulp types. These alternatives will embody the principles of lifting, mixing and pulse generation as described above.

Various other features and advantages of the invention will be apparent from the following claims.

What is claimed is:

1. A rotor adapted for use in a hydrodynamic device comprising:

a screen having a circumferentially continuous apertured zone, said rotor having an axis of rotation and including an outer surface, and further including a plurality of spaced apart sets of a plurality of closely adjacent but spaced apart vane members supported above the rotor surface, the spacing between each of said adjacent vane members being substantially less than the spacing between said sets, flow being permitted completely around each of said vane members, said rotor being mounted within and co-axial with the screen to define a screening chamber of some length between said rotor surface and said screen, each of said vane members extending the length of said screening chamber in the direction of said rotor axis, with at least two of said vane members having a similar angle of attack relative to said screen.

2. The rotor of claim 1, wherein at least one of said vane members is an air foil.

3. The rotor of claim 1, wherein said rotor includes a plurality of such sets spaced apart in a direction circumferential to said rotor axis.

4. The rotor of claim 3, wherein said sets are equally spaced apart in a direction circumferential to said rotor axis.

5. The rotor of claim 1, wherein in said plurality of vane members are supported by a plurality of brackets.

6. The rotor of claim 1, wherein said rotor surface is adjacent said screen surface.

7. The rotor of claim 1, wherein said at least two vane members of each set are an air foil.

8. The rotor of claim 7, wherein said first air foil is spaced apart from said screen surface, and said second air foil is spaced apart from said screen surface but closer to said screen surface than said first air foil, and wherein there is a third vane member, said third vane member being spaced apart from said screen surface but closer to said screen surface than said second air foil, said third vane member having an obtuse triangle shape.

9. The rotor of claim 8 wherein said third vane member has-one side generally parallel to said screen surface, another side rearward of flow and generally perpendicular to flow, and the last side forward of flow and angled relative to said screen surface.

10. The rotor of claim 1, wherein said rotor further includes a collar attached to the inlet end of the rotor, and said rotor further includes a plurality of spaced apart solid rods extending radially from said collar, with each rod being angled from the radial direction in a direction away from the direction of rotor rotation.

11. The rotor of claim 1, wherein there is a third vane member having an obtuse triangle shape.

12. The rotor of claim 11 wherein said third vane member has-one side generally parallel to said screen surface, another side rearward of flow and generally perpendicular to flow, and the last side is forward of flow and is angled relative to said screen surface.

13. A rotor adapted for use in a hydrodynamic device comprising:

a cylindrical screen having a circumferentially continuous apertured zone, said rotor having an axis of rotation and including a substantially cylindrical outer surface, and a plurality of spaced apart sets of a plurality of closely adjacent but spaced apart vane members supported above a substantially cylindrical outer surface of a rotor, the spacing between each of said adjacent vane members being substantially less than the spacing between said sets, flow being permitted completely around each of said vane members, said rotor having an axis of rotation and being mounted within and co-axial with said cylindrical screen to define an annular screening chamber between said rotor and said screen, said vane members extending the length of said screening chamber parallel to said rotor axis axis, with at least two of said vane members having a similar angle of attack relative to said screen.

14. The rotor of claim 13, wherein said sets are equally spaced apart in a direction circumferential to said rotor axis.

15. The rotor of claim 13, wherein at least one of said vane members is an air foil.

16. The rotor of claim 13, wherein said plurality of vane members are supported by a plurality of brackets.

17. The rotor of claim 13, wherein said rotor surface is adjacent said screen surface.

18. The rotor of claim 13, wherein at least two of said vane members of each set are an air foil.

19. The rotor of claim 18, wherein said first air foil is spaced apart from said screen surface, and said second air foil is spaced apart from said screen surface but closer to said screen surface than said first air foil, and wherein there is a third vane member, said third vane member being spaced apart from said screen surface but closer to said screen surface than said second air foil, said third vane member being an obtuse triangle in shape.

20. The rotor of claim 19 wherein said third vane member has-one side generally parallel to said screen surface, another side rearward of flow and generally perpendicular to flow, and the last side forward of flow and angled relative to said screen surface.

21. The rotor of claim 13, wherein said rotor further includes a collar attached to the inlet end of the rotor, and said rotor further includes a plurality of spaced apart solid rods extending radially from said collar, with each rod being angled from the radial direction in a direction away from the direction of rotor rotation.

22. A rotor adapted for use in a hydrodynamic device comprising:

a screen having a circumferentially continuous apertured zone, said rotor having an axis of rotation and including an outer surface, and further including a plurality of spaced apart sets of a plurality of closely adjacent but spaced apart vane members supported above the rotor surface, the spacing between each of said adjacent vane members being substantially less than the spacing between said sets, flow being permitted completely around each of said vane members, said rotor being mounted within and co-axial with the screen to define a screening chamber of some length between said rotor surface and said screen, each of said vane members extending the length of said screening chamber in the direction of said rotor axis, with one of said vane members having an obtuse triangle shape.

23. The rotor of claim 22 wherein said one vane member has-one side generally parallel to said screen surface, another side rearward of flow and generally perpendicular to flow, and the last side forward of flow and angled relative to said screen surface.

24. The rotor of claim 22, wherein at least one of said vane members is an air foil.

25. The rotor of claim 22, wherein said rotor includes a plurality of such sets spaced apart in a direction circumferential to said rotor axis.

26. The rotor of claim 25, wherein said sets are equally spaced apart in a direction circumferential to said rotor axis.

27. The rotor of claim 22, wherein in said plurality of vane members are supported by a plurality of brackets.

28. The rotor of claim 22, wherein said rotor surface is adjacent said screen surface.

29. The rotor of claim 22, wherein at least two of said vane members of each set are an air foil.

30. The rotor of claim 29, wherein said first air foil is spaced apart from said screen surface, and said second air foil is spaced apart from said screen surface but closer to said screen surface than said first air foil.

31. The rotor of claim 22, wherein said rotor further includes a collar attached to the inlet end of the rotor, and said rotor further includes a plurality of spaced apart solid rods extending radially from said collar, with each rod being angled from the radial direction in a direction away from the direction of rotor rotation.

32. A rotor adapted for use in a hydrodynamic device comprising:

a cylindrical screen having a circumferentially continuous apertured zone, said rotor having an axis of rotation and including a substantially cylindrical outer surface, and a plurality of spaced apart sets of a plurality of adjacent vane members supported above a substantially cylindrical outer surface of a rotor, said rotor having an axis of rotation and being mounted within and co-axial with said cylindrical screen to define an annular screening chamber between said rotor and said screen, said vane members extending the length of said screening chamber parallel to said rotor axis, with one of said vane members having an obtuse triangle shape.

33. The rotor of claim 32 wherein said one vane member has-one side generally parallel to said screen surface, another side rearward of flow and generally perpendicular to flow, and the last side forward of flow and angled relative to said screen surface.

34. The rotor of claim 32, wherein said sets are equally spaced apart in a direction circumferential to said rotor axis.

35. The rotor of claim 32, wherein at least one of said vane members is an air foil.

36. The rotor of claim 32, wherein said plurality of vane members are supported by a plurality of brackets.

37. The rotor of claim 32, wherein said rotor surface is adjacent said screen surface.

38. The rotor of claim 32, wherein at least two of said vane members of each set are an air foil.

39. The rotor of claim 38, wherein said first air foil is spaced apart from said screen surface, and said second air foil is spaced apart from said screen surface but closer to said screen surface than said first air foil, and wherein said third obtuse triangle shaped vane member is spaced apart from said screen surface but closer to said screen surface than said second air foil, has a blunt leading edge in the direction of movement of the vane member into the pulp, with one side generally parallel to the screen surface, another side rearward of flow and slightly angled relative to the screen surface, and a last side forward of flow and angled relative to the screen surface.

40. The rotor of claim 39, wherein said rotor further includes a collar attached to the inlet end of the rotor, and said rotor further includes a plurality of spaced apart solid rods extending radially from said collar, with each rod being angled from the radial direction in a direction away from the direction of rotor rotation.

41. A rotor adapted for use in a hydrodynamic device comprising:

a screen having a circumferentially continuous apertured zone, said rotor having an axis of rotation and including an outer surface, and further including a plurality of spaced apart sets of a plurality of at least three adjacent vane members supported above the rotor surface, said rotor being mounted within and co-axial with the screen to define a screening chamber of some length between said rotor surface and said screen, each of said vane members extending the length of said screening chamber in the direction of said rotor axis, and said first vane member is an air foil spaced apart from said screen surface, and said second vane member is an air foil and is spaced apart from said screen surface but closer to said screen surface than said first air foil, and said third vane member is spaced apart from said screen surface but closer to said screen surface than said second air foil, said third vane member being uniquely shaped, with one side generally parallel to said screen surface, another side rearward of flow and generally perpendicular to flow, and the last side forward of flow and angled relative to said screen surface.

* * * * *